United States Patent [19]

Kasprzak et al.

[11] Patent Number: 4,848,981

[45] Date of Patent: Jul. 18, 1989

[54] METHOD OF IMPROVING THE DRAINING OF WATER FROM TEXTILES DURING A LAUNDERING OPERATION

[75] Inventors: Kenneth A. Kasprzak, Saginaw Township, Saginaw County; John D. Blizzard, Bay City, both of Mich.

[73] Assignee: Dow Corning Corp., Midland, Mich.

[21] Appl. No.: 801,447

[22] Filed: Nov. 25, 1985

[51] Int. Cl.[4] ..... D06L 1/12

[52] U.S. Cl. ..... 8/137; 427/387; 427/393.3; 8/581; 8/DIG. 1

[58] Field of Search ..... 252/8.8, 174.15; 8/137, 8/581, DIG. 1; 427/387, 383.3; 428/447, 266, 391

[56] References Cited

U.S. PATENT DOCUMENTS

| | | | |
|---|---|---|---|
| 3,440,261 | 4/1969 | Saam | 260/448.2 |
| 4,246,029 | 1/1981 | Sanders, Jr. | 106/3 |
| 4,247,592 | 1/1981 | Kalinowski | 428/266 |
| 4,290,896 | 9/1981 | Gordon et al. | 210/710 |
| 4,427,815 | 1/1984 | Ona et al. | 252/8.8 |
| 4,448,810 | 5/1984 | Westall | 252/8.8 |
| 4,501,619 | 2/1985 | Gee | 106/287.12 |
| 4,507,455 | 3/1985 | Tangney et al. | 528/38 |

FOREIGN PATENT DOCUMENTS 1549180 7/1979 United Kingdom .

*Primary Examiner*—Paul Lieberman
*Assistant Examiner*—John F. McNally

[57] ABSTRACT

A method of laundering textiles is disclosed wherein amidofunctional silicone is dispersed in the rinse water to improve the flow of water out of the textiles during the subsequent spin-separation of water. The resulting textiles contain less residual water and can be dried more rapidly and energy efficiently. The useful amidofunctional silicones are characterized as having an average of 40 to 600 siloxane units per molecule with 1 to 25 of the siloxane units per molecule containing an amidoalkyl substituent.

7 Claims, No Drawings

METHOD OF IMPROVING THE DRAINING OF WATER FROM TEXTILES DURING A LAUNDERING OPERATION

BACKGROUND OF THE INVENTION

This invention relates to a method of laundering clothing and textiles in an aqueous wash bath. In particular it relates to a method of facilitating the flow of water out of clothing and textiles during the final rinse stage of the laundering cycle by using small amounts of amidoalkyl-containing polydiorganosiloxane in the rinse bath.

Automatic clothes washing machines employ a variety of wash cycles with a number of machine stages which usually include an agitated wash using an aqueous detergent solution, a spin-filter to remove the aqueous detergent solution and soil, an agitated rinse bath to remove residual detergent and soil, and a final spin-filter to remove the aqueous rinse bath. After the final spin-filter stage, the water retained in the clothing and textiles is removed by a drying step which typically includes blowing heated air over the tumbling textiles in a clothes drying machine.

The thermal drying of clothes and textiles is time consuming and requires considerable energy. Consequently, it is an object of the present invention to facilitate the drying of clothes and textiles after laundering by providing a method of washing clothes and textiles wherein the amount of water retained in the fabric after the final spin-filter, is reduced.

It has been known for a long time to employ fabric conditioning compositions in the rinse step of textile laundering to confer on textiles such well-known benefits as softening, anti-wrinkling, smoothness, ease-of-ironing, whitening and perfuming. The active softening ingredient is usually selected from the group of cationic and/or nonionic fabric substantive agents. Well-known cationic fabric softening agents include the organic quaternary ammonium compounds having either one or two higher alkyl substituents such as ditallowdimethylammonium chloride and tallowtrimethylammonium chloride. Nonionic softening actives include polyethoxylates, fatty acid esters, paraffins, fatty alcohols and fatty acids.

Great Britain Patent Specification No. 1,549,180 further teaches fabric conditioning compositions comprising a combination of organic cationic fabric-softening agents and certain types of silicone materials. The combination is reported to provide a very desirable softening effect and such additional benefits as ease-of-ironing for the textile. The Great Britain patent also teaches that if normal commercial silicones are applied to fabrics from dilute aqueous systems, they are not substantive to a useful degree, in that insufficient silicone is present in the dilute residual liquor in the fabric to provide any appreciable effect. On the other hand, it is taught that the silicone in the presence of the organic cationic agent tends to migrate with the organic cationic agent to the surface of the fabric where it is sufficiently concentrated to provide fabric conditioning benefits. Silicones with cationic character such as the hydrochloride salt derivative of polydimethylsiloxane substituted with dimethylaminopropyl groups are included among the types of silicone employed with the organic cationic fabric-softening agent.

U.S. Pat. No. 4,247,592 teaches a method for treating synthetic textiles with aminoalkyl-containing polydiorganosiloxanes to provide a crosslinked siloxane on the surface of the treated fiber without diminishing the fire-retardancy rating of the fibers. It is taught specifically that appropriate polydiorganosiloxanes contain an average of up to 100 dimethylsiloxane units and two nitrogen-containing siloxane units per molecule, where the nitrogen-containing siloxane units have a substituent such as $-CH_2CH_2CH_2NHCH_2CH_2NH_2$. It is further taught that the "hand" of nylon fabric can be improved by adding specified polydiorganosiloxanes to the rinse water while washing the fabric in an automatic clothes washing machine.

Amidofunctional siloxane polymers containing substituents such as $$-CH_2CH_2CH_2NHCH_2CH_2NH\overset{\overset{\displaystyle O}{\|}}{C}CH_3$$

attached to silicon are described in U.S. Pat. No. 3,440,261. The amidofunctional siloxanes are reported generally to be useful as coupling agents for the preparation of glass cloth-resin laminates and as textile treating agents to improve the dyeability of the textile with acid dyes. Amido-functional siloxane polymers are further described in U.S. Pat. No. 4,507,455 which is commonly owned with the present application. The use of amidofunctional siloxanes as mold release and hair conditioning agents is described in this patent.

Copending U.S. patent application Ser. No. 737,592 which is commonly owned with the present application, describes a fabric softener composition containing a blend of a conventional, cationic organic softening agent and a polydiorganosiloxane having an amidofunctional substituent of the formula $$-CH_2CH_2CH_2NHCH_2CH_2NH\overset{\overset{\displaystyle O}{\|}}{C}CH_3 \text{ or}$$

$$-CH_2CH_2CH_2N(\overset{\overset{\displaystyle O}{\|}}{C}CH_3)CH_2CH_2NH\overset{\overset{\displaystyle O}{\|}}{C}CH_3.$$

Fabric softener compositions are employed during the rinse or drying cycle of a laundry operation to improve the softness of hand of the laundered fabric.

None of the above references suggest in any way that polydiorganosiloxanes can be used during textile laundering to improve the draining of water out of the textiles during the final rinse step. However, in another art area, U.S. Pat. No. 4,290,896 teaches that a wide variety of silicone materials can be used in fine coal dewatering processes to improve the separation of water from the coal. Among the silicone materials described in this reference is a polydiorganosiloxane containing 98 dimethylsiloxane units and 2 siloxane units having $-CH_2CH_2CH_2NHCH_2CH_2NH_2$ as a substituent.

Applicants' copending U.S. patent application Ser. No. 718,403 teaches the use of aminofunctional silicones to improve the draining of water out of textiles during laundry operations.

SUMMARY OF THE INVENTION

The present invention relates to a method of laundering textiles including the steps of agitating the textiles in an aqueous wash bath, separating the aqueous wash bath from the textiles, agitating the textiles in an aqueous rinse bath, separating the aqueous rinse bath from the textiles, and drying the textiles. The improvement in the method comprises dispersing an amount, sufficient to improve the water draining, of a polysiloxane in the aqueous rinse prior to separating the rinse bath from the textiles. The polysiloxane is a triorganosiloxane-endblocked polydiorganosiloxane having an average of 40 to 600 siloxane units per molecule with an average of 1 to 2 of the siloxane units per molecule being amide-containing siloxane units. The amide-containing siloxane units bear a substituent of the formula $$-R'(\underset{\underset{X'}{|}}{N}CH_2CH_2)_n\underset{\underset{X}{|}}{N}R''$$

wherein n is 0 or 1, R′ denotes an alkylene radical of 3 to 6 carbon atoms, and R″ denotes a hydrogen radical or an alkyl radical of 1 to 6 carbon atoms, X denotes an acyl radical of the formula $$-\overset{\overset{O}{\|}}{C}R''',$$

X′ denotes a hydrogen radical or X, and R‴ denotes an alkyl radical of 1 to 4 carbon atoms and substantially all other organic substituents in the polydiorganosiloxane being methyl groups.

DETAILED DESCRIPTION OF THE INVENTION

This invention is based on the discovery that a small amount of silicone, dispersed in the final rinse water during the laundering of textiles, improves the flow of water out of the textiles during the subsequent spin-filter operation so that the textiles contain less residual water and can be dried more rapidly and energy efficiently. In general, it has been found that a fairly wide variety of silicone materials provide some improvement in water draining from textiles. Most important for the present invention, it has been discovered that the extent of improvement in water draining is surprisingly greater when a certain class of amidoalkyl-containing polydiorganosiloxanes is employed.

Although the exact manner in which the polysiloxane improves the flow of water out of the textiles is not completely understood, it does appear that the unique functional groups of the amidofunctional silicone are important in providing attraction for the silicone to the fabric surface and thus positioning the silicone at the textile water interface where the silicone's effect on water draining can be most fully expressed.

Generally, silicone may be dispersed in rinse water combined with other laundry additives such as fabric conditioning compositions. However, many people prefer to add fabric softening products during the drying cycle instead of during the aqueous rinse cycle in laundry operations. Under these circumstances, it would not be efficient to add compositions containing a combination of silicones and conventional organic fabric softening components to the rinse water. Surprisingly, it has been found that significant water draining improvements are obtained when amidofunctional silicones are employed in the rinse cycle as essentially single component compositions. More surprising, the improvements are obtained even when using only very small amounts of silicone in the rinse water. Moreover, at the same time that such compositions were found effective to improve water draining, they were also found to be so effective at conditioning and softening textiles that subsequent use of conventional fabric softening compositions became unnecessary in many cases.

The silicone can be added to the rinse water in any convenient manner. Generally it is most convenient to prepare an aqueous composition containing a suspension or an emulsion of the amidofunctional silicone and then add appropriate amounts of the aqueous emulsion to the rinse water in the automatic clothes washing machine.

Any suitable aqueous suspension or emulsion of the amidofunctional silicone can be employed in accordance with this invention. Generally, it is preferred to employ a silicone emulsion or suspension which is stable in the rinse bath in the presence of the residual amounts of detergent components which may be present. Preferred aqueous emulsions for the method of this invention may be prepared by emulsifying the amidofunctional silicone in water using a suitable emulsifying agent such as a nonionic emulsifying agent.

More specifically, the preferred embodiment of the present invention encompasses the addition of silicone emulsion, which is substantially free of organic fabric softening components, to the rinse water in a textile laundry operation. Substantially free of organic fabric softening components means that the silicone emulsion generally contains less than 2 weight percent and preferably less than 1 weight percent of fabric softening component. For the purposes of this invention fabric softening components are substantially water-insoluble cationic organic compounds having one or two large alkyl groups, typically containing 12 to 30 carbon atoms. For example, fabric softening components include di(hydrogenated tallow)dimethylammonium chlorides, diamido alkoxylated quaternary ammonium compounds and quaternized amido imidazolines.

Of course, the silicone emulsions employed in the method of this invention may contain nonionic surfactants suitable for aiding the formation and maintaining the stability of the silicone oil droplets within the water carrier. The amount of surfactant used in the silicone emulsions may vary depending on the particle size that is desired, but typically will not be more than about 50 percent of the weight of the silicone. Any of the well known methods for emulsifying aminofunctional or carboxyfunctional silicone oils can also be used to emulsify the amidofunctional silicone oils of this invention. Methods of emulsifying aminofunctional and carboxyfunctional silicones are described in U.S. Pat. Nos. 4,246,029 and 4,501,619 which are hereby incorporated by reference to further exemplify the methods and nonionic surfactants that are useful in this invention.

Any amount of silicone that improves the dewatering of textiles during the spin-filter step of the laundering process can be employed in accordance with this invention. In most instances it is desirable for economy to employ very small amounts of the aminofunctional silicone in the rinse water. For example, it is preferred to use only about 0.01 to 0.5 gram of silicone per liter of rinse water. It is even more preferred to use 0.01 to 0.25 gram of silicone per liter of rinse water. While greater amounts of silicone will improve the draining of water from textiles according to this invention, the use of greater amounts is less preferred because of economic considerations.

The silicone component that is dispersed in the aqueous rinse bath in accordance with this invention consists essentially of a triorganosiloxane-endblocked polydiorganosiloxane which contains amidoalkyl substituents. Triorganosiloxane-endblocked polydiorganosiloxanes (amidofunctional silicone) consist essentially of terminal triorganosiloxane units of the formula $R_3SiO_{\frac{1}{2}}$ and backbone diorganosiloxane units of the formula $R_2SiO_{2/2}$. Trace amounts of other siloxane units in amidofunctional silicone, such as $SiO_{4/2}$ and $RSiO_{3/2}$, which are normally present as impurities in commercial polydiorganosiloxanes may be present. Preferably there are no $SiO_{4/2}$ units or $RSiO_{3/2}$ units in the amidofunctional silicones.

The R radicals of the above siloxane units are substantially either amide-containing radicals of the formula $$-R'(\underset{\underset{X'}{|}}{N}CH_2CH_2)_nN\underset{\underset{X}{|}}{R''}$$

or methyl radicals. Minor amounts of other organic substituents which are normally present as impurities in commercial polydiorganosiloxanes may be present. It should be understood, for example, that the amidofunctional silicones of this invention are often prepared by acylation of corresponding aminofunctional silicones. Consequently, the amidofunctional silicones may also contain residual aminofunctional siloxane units. For example, siloxanes units such as $H_2NCH_2CH_2NHCH_2CH(CH_3)CH_2SiO_{2/2}$ or $H_2NCH_2CH_2CH_2SiO_{2/2}$ may also be present in the amidofunctional silicones useful in this invention. However, for the purposes of this invention it is preferred to employ silicone oils that do not contain significant levels (more than 25 percent of the number of amidofunctional substituents) of the unmodified aminofunctional siloxane units.

In the formula for the amide-containing radicals, R' denotes an alkylene radical of 3 to 6 carbon atoms, such as $-CH_2CH_2CH_2-$, $-CH_2CH_2CH_2CH_2-$, $-CH_2CH(CH_3)CH_2-$, $-CH_2CH_2CH_2CH_2CH_2-$, and $-CH_2CH(CH_2CH_3)CH_2-$. Amidofunctional silicones wherein the silicon bonded, amide-containing radicals have a trimethylene radical or an alkylated trimethylene radical, such as $-CH_2CH(CH_3)CH_2-$, as the R' radical are preferred because of ease of synthesis and availability.

R'' denotes a hydrogen radical, which is a preferred R'' radical, or an alkyl radical of 1 to 6 carbon atoms, such as methyl, ethyl, propyl, butyl, and isobutyl.

In the formula for the amide-containing radicals, n has a value of 0 or 1, so that the radical may contain one or two nitrogen atoms. X denotes an acyl radical of the formula $$-\overset{\overset{O}{\|}}{C}R'''$$

and X' denotes a hydrogen radical or X. In the acyl radical, R''' denotes an alkyl radical of 1 to 4 carbon atoms such as methyl, ethyl, propyl, isopropyl, or butyl.

In accordance with the above, triorganosiloxane-endblocked polydiorganosiloxanes preferred for use in the method of this invention consist essentially of siloxane units selected from the following:

$$R''N(\overset{\overset{O}{\|}}{C}R''')CH_2CH_2NHR'(CH_3)_2SiO_{1/2},$$

$$R''N(\overset{\overset{O}{\|}}{C}R''')CH_2CH_2N(\overset{\overset{O}{\|}}{C}R''')R'(CH_3)_2SiO_{1/2},$$

$$R''N(\overset{\overset{O}{\|}}{C}R''')CH_2CH_2NHR'(CH_3)SiO_{2/2},$$

$$R''N(\overset{\overset{O}{\|}}{C}R''')CH_2CH_2N(\overset{\overset{O}{\|}}{C}R''')R'(CH_3)SiO_{2/2},$$

$$R''N(\overset{\overset{O}{\|}}{C}R''')R'(CH_3)_2SiO_{1/2},\ R''N(\overset{\overset{O}{\|}}{C}R''')R'(CH_3)SiO_{2/2},$$

$(CH_3)_3SiO_{\frac{1}{2}}$, and $(CH_3)_2SiO_{2/2}$ wherein R', R''', and R''' have the same meanings as described above. It should be understood that any of the siloxane units having non-acylated nitrogen atoms can also be present in their salt form. It is well known that the salt form occurs when such polymers are neutralized by acids such as mineral acids or carboxylic acids.

It is most preferred that the silicone polymers of this invention contain amide-containing siloxane units of the formula $$R''N(\overset{\overset{O}{\|}}{C}R''')CH_2CH_2NHR'(CH_3)SiO_{2/2},$$

wherein R', R'', and R''' have the same meanings as described above. These preferred amide-containing units have a ratio of acyl groups to nitrogen atoms of about 0.5. It has been found that amidofunctional silicones with a ratio of acyl groups to nitrogen atoms of about 0.5 provide the most consistently large improvement in water draining when employed in the method of this invention.

The average degree of polymerization of the amidofunctional siloxanes of this invention can vary over a wide range. Likewise, the number of siloxane units per molecule bearing amide substituents, $$-R'(\underset{\underset{X'}{|}}{N}CH_2CH_2)_nN\underset{\underset{X}{|}}{R''},$$

can vary over a wide range. In general, polymers having 40 to 600 siloxane units per molecule with an average of 1 to 25 amide substituents per molecule are believed to be most suitable for use in the present invention. Silicone polymers having 50 to 300 siloxane units per molecule with 4 to 25 amide substituents per molecule are even more preferred because of their superior ability to increase the draining of water out of textiles. In other words, preferred amidofunctional siloxanes have an average degree of polymerization of 50 to 300 with sufficient amidofunctional siloxane units to provide an average of 4 to 25 amidofunctional substituents per molecule.

It is most preferred for maximum effectiveness and economy to use amidofunctional silicone polymers having an average of 150 to 250 siloxane units per molecule with an average of 6 to 15 amidofunctional substituents per molecule.

The amidofunctional silicones of this invention have the advantage that they do not bind as strongly to textiles as other functional silicones. For example, in some cases the aminofunctional silicones bind so strongly to textiles that they tend to build up on the textile surface. As the silicone coating builds, the textiles become hydrophobic and lose their ability to rapidly absorb water. Hydrophobicity is undesirable especially for such items as cotton towels.

Methods of preparing the triorganosiloxane-endblocked polydiorganosiloxane polymers that are employed according to this invention are described in U.S. Pat. Nos. 3,440,261 and 4,507,455 which are hereby incorporated by reference. Typically, the polymers are prepared by acylating suitable aminoalkyl-substituted siloxanes by reaction with anhydrides of carboxylic acids such as, for example, acetic anhydride or propionic anhydride. It should be recognized that amidofunctional silicones prepared by the above method may contain small amounts of the aminoalkyl-substituted siloxane units which have not been acylated. Generally small amounts of such units do not interfere with the functioning of the amidofunctional silicone in accordance with the present invention. However, it is preferred for the purposes of the present invention that each nitrogen-containing siloxane unit in the polymer have an acyl radical attached to at least one of the nitrogen atoms in the substituent.

Methods for preparing the aminoalkyl-substituted siloxanes from which the amidofunctional silicones are often derived, are well known in the art. For example, a triorganosiloxane-endblocked polydiorganosiloxane bearing a number of suitably reactive groups per molecule, such as —SiH or —$SiCH_2CH_2CH_2Cl$, may be reacted with $CH_2{=}C(CH_3)CH_2NH_2CH_2NH_2$ or $H_2NCH_2CH_2NH_2$, respectively, to provide an analogous polydiorganosiloxane wherein the reactive groups have been converted to —$CH_2CH(CH_3)CH_2NHCH_2CH_2NH_2$ groups and $CH_2CH_2CH_2NHCH_2CH_2NH_2$ groups, respectively. Alternatively, a suitable aminofunctional silicone may be prepared from aminoalkyl-substituted silanes or siloxanes using well known methods of hydrolysis and equilibration.

The method of this invention is further illustrated by the following examples, however, the examples should not be regarded as limiting the invention which is delineated by the appended claims.

In the examples, all parts are by weight unless otherwise indicated. Amine neutral equivalent (ANE) denotes the parts by weight of a material that is required to provide 14.007 parts by weight of amine and/or amine salt nitrogen (i.e. non-acylated nitrogen). It was determined by dissolving the sample in a mixture of toluene and glacial acetic acid and titrating the solution anhydrously with perchloric acid to a methyl violet endpoint.

EXAMPLE 1

This example illustrates a method of preparing amido-functional silicone suitable for use in the present invention.

An aminoalkyl-substituted silicone was prepared by hydrolyzing $(CH_3O)_2CH_3SiCH_2CH(CH_3)CH_2NHCH_2CH_2NH$ with water and equilibrating the resulting hydrolyzate with dimethylsiloxane hydrolyzate and decamethyltetrasiloxane using potassium silanolate as catalyst. The base catalyst was neutralized with acetic acid and the product was filtered. The resulting silicone fluid had a viscosity of 501 cs and an ANE of 809 after stripping to remove a minor amount (5 to 10%) of volatiles. The silicone fluid is represented by the average formula $$(CH_3)_3SiO[(CH_3)_2SiO]_{188}(CH_3SiO)_{10}Si(CH_3)_3$$
$$|$$
$$CH_2CH(CH_3)CH_2NHCH_2CH_2NH_2$$

which is based on the ratio of the various siloxane units employed in the polymer's preparation.

Amidofunctional silicone was prepared by slowly adding acetic anhydride (48.9 g) to the aminoalkyl-substituted silicone (780 g) and mixing for 25 min. The product was vacuum (10 mm Hg) stripped for 45 min. at 150° C. The resulting silicone fluid had a viscosity of 1570 cs and an ANE of 1927 which is reasonably consistent with a ratio of acetyl groups to nitrogen atoms of about 0.5. This amidofunctional silicone fluid is represented by the average formula $$(CH_3)_3SiO[(CH_3)_2SiO]_{188}(CH_3SiO)_{10}Si(CH_3)_3 \qquad O$$
$$| \qquad\qquad\qquad\qquad\qquad\qquad \|$$
$$CH_2CH(CH_3)CH_2NHCH_2CH_2NHCCH_3$$

although it should be recognized that some of the acetyl groups may also be positioned on the secondary nitrogen.

A second amidofunctional silicone was prepared by slowly adding acetic anhydride (97.8 g) to the aminoalkyl-substituted silicone (780 g) and mixing for 25 min. The product was vacuum (10 mm Hg) stripped for 45 min. at 150° C. The resulting silicone fluid had a viscosity of 10,777 cs and an ANE of 140,165 which is consistent with a ratio of acetyl groups to nitrogen atoms of about 1. This amidofunctional silicone fluid is represented by the average formula $$(CH_3)_3SiO[(CH_3)_2SiO]_{188}(CH_3SiO)_{10}Si(CH_3)_3 \qquad O \qquad\qquad O$$
$$| \qquad\qquad\qquad\qquad\qquad\qquad \| \qquad\qquad \|$$
$$CH_2CH(CH_3)CH_2N(CCH_3)CH_2CH_2NHCCH_3.$$

EXAMPLE 2

A standard bundle of 86% cotton/14% polyester towels was washed in an automatic clothes washer using a normal wash cycle comprising a wash/spin/rinse/spin sequence. The bundle was washed five times using a laundry detergent and then five times in only water. After completion of the final rinse/spin portion of the wash cycles, the bundle was weighed and the weight percent of water retained by the towels was calculated. The towels were then dried to a standard moisture content in an electric clothes drier.

The bundle of towels was then run through several wash cycles during which an emulsion of an amidofunctional silicone was dispersed in the rinse bath via the fabric-softener dispenser located on the agitator of the automatic clothes washer. After completion of each rinse/spin portion of the wash cycles, the towels were again weighed and the weight percent of water retained was calculated. The towels were again dried to the standard moisture content.

The difference between the weight percent of water retained using an amidofunctional silicone in the rinse and the weight percent of water retained without the amidofunctional silicone in the rinse is shown in Table 1 for a number of amidofunctional silicones of varying degree of polymerization and amide functionality. The silicones were prepared by the procedure of Example 1. Negative values indicate that less water was retained in the fabric when the amidofunctional silicone was present in the rinse water.

The polysiloxane emulsions used in the washing tests were prepared by mixing nonionic surfactants [17.6 g of 2,6,8-trimethyl-4-nonyl(oxyethylene)$_6$ alcohol and 49.6 g of octophenyl(oxyethylene)$_{40}$ alcohol] with water (304 g) and then slowly adding amidofunctional silicone (200 g) while the mixture is being homogenized on a colloid mill.

TABLE I

| Polydiorganosiloxane | | | | Results Difference in Wt. % $H_2O$ Retained Number of Wash Cycles | | | | | |
|---|---|---|---|---|---|---|---|---|---|
| Trial No. | Nominal D.P. | Nitrogen-Containing Siloxane Units per Molecule | Ratio of Acyl Groups to Nitrogen Atoms | 1 | 2 | 3 | 4 | 5 | 6 |
| 1 | 200 | 10 | 0.5 | −21.3 | −24.3 | | | | |
| 2 | 200 | 10 | 0.5 | −18.6 | −17.5 | | | | |
| 3 | 200 | 10 | 1.0 | +0.3 | +4.2 | +16.6* | +15.7 | +16.8 | +14.8 |
| 4 | 200 | 10 | 1.0 | −0.6 | +1.6 | | | | |
| 5 | 400 | 8 | 0.5 | −9.7 | −10.2 | | | | |
| 6 | 400 | 8 | 1.0 | −9.3 | −0.9 | −5.1 | −9.0 | −14.4 | −15.4 |
| 7 | 100 | 2 | 0.5 | −9.9 | −15.0 | | | | |
| 8 | 100 | 2 | 1.0 | −7.5 | −11.5 | −4.8 | −6.7 | −7.9 | −8.3 |

*evident discontinuity in the experimental results

The data in Table 1 demonstrates the improvement in water draining from textiles that is obtained by using the amidofunctional silicones in the rinse cycle of laundry operations. Trial 1 and 2 of Table 1 also illustrates the superior results obtained with specific amidofunctional silicones which are characterized by having degrees of polymerization and levels of amide-containing siloxane units within preferred limits.

The energy (measured in watt-hours) used to dry the towel bundles from Trials 1 and 2 in Table 1 was also determined and compared to the energy used to dry the same towel bundles when washed without amidofunctional silicones in the rinse cycle. Energy savings on individual bundles ranged from 6.7 to 13.4 percent with average savings of 9.8 percent. This data indicates that improvements in water draining such as illustrated in Trials 1 and 2 of Table 1 do correlate to energy savings in laundry operations.

That which is claimed is:

1. In a method of laundering textiles including the steps of agitating the textiles in an aqueous wash bath, separating the aqueous wash bath from the textiles, agitating the textiles in an aqueous rinse bath, separating the aqueous rinse bath from the textiles and drying the textiles, the improvement comprising dispersing an amount, sufficient to improve the water draining, of a composition in the aqueous rinse bath wherein the composition consists essentially of a triorganosiloxane-endblocked polydiorganosiloxane having an average of 40 to 600 siloxane units per molecule with an average of 1 to 25 of the siloxane units per molecule being amide-containing siloxane units bearing a substituent of the formula $$-\underset{\underset{X'}{|}}{R'}(NCH_2CH_2)_n\underset{\underset{X}{|}}{NR''}$$

wherein n is 0 or 1, R' denotes an alkylene radical of 3 to 6 carbon atoms, and R'' denotes a hydrogen radical or an alkyl radical of 1 to 6 carbon atoms, X denotes an acyl radical of the formula $$-\overset{\overset{O}{\|}}{C}R''',$$

X' denotes a hydrogen radical or X, and R''' denotes an alkyl radical of 1 to 4 carbon atoms and substantially all other organic substituents in the polyiorganosiloxane being methyl groups wherein the amount of the composition dispersed in the rinse bath is sufficient to provide 0.01 to 0.5 gram of triorganosiloxane-endblocked polydiorganosiloxane per liter of water in the rinse bath.

2. A method according to claim 2 wherein the amount of the composition dispersed in the rinse bath is sufficient to provide 0.025 to 0.25 gram of triorganosiloxane-endblocked polydiorganosiloxane per liter of water in the rinse bath.

3. A method according to claim 3 wherein the triorganosiloxane-endblocked polydiorganosiloxane has an average of 50 to 300 siloxane units per molecule with an average of 4 to 25 of the siloxane units per molecule being amide-containing siloxane units.

4. A method according to claim 4 wherein the triorganosiloxane-endblocked polydiorganosiloxane has an average of 150 to 250 siloxane units per molecule with an average of 6 to 15 of the siloxane units per molecule being amide-containing siloxane units.

5. A method according to claim 4 wherein the amide-containing siloxane units bear a substituent of the formula $$-R'NHCH_2CH_2NH\overset{\overset{O}{\|}}{C}R'''$$

wherein R' denotes a trimethylene or a methyl substituted trimethylene radical.

6. A method according to claim 5 wherein the polydiorganosiloxane is endblocked by trimethylsiloxane units and is composed of dimethylsiloxane unit and units of the formula
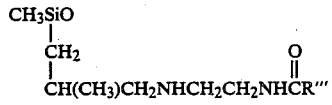
wherein R''' denotes an alkyl radical of 1 to 4 carbon atoms.
7. A method according to claim 6 wherein R''' denotes a methyl radical.
* * * * *